US006152109A

United States Patent [19]

Melchior

[11] Patent Number: 6,152,109

[45] Date of Patent: Nov. 28, 2000

[54] LIQUID FUEL INJECTING DEVICE FOR INTERNAL COMBUSTION ENGINE

[76] Inventor: Jean Frederic Melchior, 157, Bd Saint-Germain - 75006, Paris, France

[21] Appl. No.: 09/180,889

[22] PCT Filed: May 14, 1997

[86] PCT No.: PCT/FR97/00861

§ 371 Date: Apr. 7, 1999

§ 102(e) Date: Apr. 7, 1999

[87] PCT Pub. No.: WO97/44583

PCT Pub. Date: Nov. 27, 1997

[30] Foreign Application Priority Data

May 17, 1996 [FR] France ..... 96 06159

[51] Int. Cl.[7] ..... F02M 37/04

[52] U.S. Cl. ..... 123/447; 123/467

[58] Field of Search ..... 123/447, 467, 123/446, 458

[56] References Cited

U.S. PATENT DOCUMENTS

| | | | |
|---|---|---|---|
| 4,572,136 | 2/1986 | Takeuchi et al. | 123/447 |
| 4,718,384 | 1/1988 | Takahashi | 123/447 |
| 4,877,187 | 10/1989 | Daly | 239/89 |
| 5,199,402 | 4/1993 | Melchior | 123/447 |
| 5,381,772 | 1/1995 | Melchior et al. | 123/447 |
| 5,469,828 | 11/1995 | Heimberg et al. | 123/497 |
| 5,809,771 | 9/1998 | Wernberg | 60/39.094 |
| 5,896,843 | 4/1999 | Lorraine | 123/467 |
| 6,053,712 | 4/2000 | Konishi et al. | 417/540 |

*Primary Examiner*—Carl S. Miller
*Attorney, Agent, or Firm*—Larson & Taylor

[57] ABSTRACT

A device for injecting high pressure atomized fuel liquid into the combustion chamber of an internal combustion engine such as a diesel engine. The device includes a mechanism for delivering high pressure liquid fuel (16) such as a pump. The mechanism communicates via a cyclic communication device with an injection chamber (26) of variable volume having a movable element (27) returned by a resilient returning element (28) towards a stop (33), and communicates permanently with the nozzle cavity (10). The amount of liquid fuel is delivered to the injection chamber during the cyclic closing phase of a nozzle obturator (14).

34 Claims, 11 Drawing Sheets

LIQUID FUEL INJECTING DEVICE FOR INTERNAL COMBUSTION ENGINE

FIELD OF THE INVENTION

The present invention relates to a liquid-fuel injection device for an internal combustion engine.

BACKGROUND OF THE INVENTION

Conventionally, liquid fuel is injected into an internal combustion engine, for example a compression-ignition engine, using a means that establishes fuel pressure, which is in the form of an injection pump capable cyclically of placing fuel under high pressure in a variable-volume chamber formed in a pump cylinder and delimited by a plunger actuated by a camshaft that is kinematically connected to the main shaft or crankshaft of the engine.

The compressed fuel is injected through an injection nozzle which communicates, via a number of injection holes with the working or combustion chamber of the engine, this nozzle including a chamber which communicates with the cylinder of the injection pump, generally through one-way passage means such as a non-return valve. The communication between this chamber and the working or combustion chamber is interrupted by a sliding needle resting, by virtue of the action of elastic return means, on a conical seat formed in the said nozzle upstream of the said injection holes.

This needle includes a cylindrical body sliding in a bore formed in the nozzle and of a diameter that exceeds that of the conical bearing surface of the needle on its seat, so that when the pressure of the fuel exceeds a certain value, known as the rated pressure of the injector, it lifts off its seat to allow injection to take place. When the plunger of the injection pump has travelled beyond a certain position, beyond which the pump cylinder will find itself in communication with low-pressure fuel-supply means, the pressure in the nozzle drops and the injection needle is returned onto its seat, to close the nozzle again, under the action of the aforementioned elastic return means.

In spite of its great simplicity, this conventional device presents serious drawbacks. Firstly, the injection pressure depends on the engine speed and varies with it. Next, because of the necessarily limited force of the return spring, the end of injection occurs at a low pressure which no longer allows the fuel to be finely atomized, this generating unburnt hydrocarbons and particles of soot.

Some of these drawbacks may be avoided using an injection device of the type proposed in Patent FR-A-1,351,593. In such a device, fuel from the pressure-establishing means, such as a pump or an accumulator, is sent to an injection chamber delimited by a plunger moving against a powerful spring, so as to fill the chamber with pressurized fuel during the non-injection phase. This chamber opens directly into the injector cavity in which the shut-off means, such as a needle whose lift can be controlled either by an independent hydraulic circuit or by a circuit using fuel, move. When the needle is made to open and therefore injection is made to take place, the needle moves, over a long travel, until it comes into abutment against the plunger of the injection chamber, this plunger, as it advances delivering fuel from the injection chamber to the injection nozzle, causing the needle to close again.

Such a device does, however, have drawbacks which make it unsuitable for use with very high injection pressures which are used in modern engines and which would result in a heightened risk of fuel leaks and in a loss of power because of some of the fuel spilling out of the injector volume into the supply circuit, not to mention the problem of over-specifying the return spring.

DOS 1,944,862 has also already described an injection device comprising an injection chamber in which a differential plunger moves and which is in direct communication with the injector, control means allowing the injection chamber to be filled, during the non-injection phase, against the action of the pressure of a fuel accumulator kept charged by a high-pressure pump. This device does, however, present appreciable drawbacks. In particular, the injection pressure is only a fraction of the pressure supplied by the pump and the end-of-injection-travel of the plunger is marked by a pressure drop that is difficult to obtain precisely, particularly in the case of very high pressures.

In order to overcome the drawbacks of these various solutions, modern developments have concentrated on accumulation-type injection systems, also known as "common rail" systems.

In such systems, an accumulator is constantly filled with fuel at high pressure by virtue of means that generate high pressure in the fuel, and permanently communicates with the chamber of the injection nozzle upstream of the seat against which, by virtue of control means, the bearing surface of the injection needle presses. A distributor allows the said chamber to be made to communicate with another chamber delimited by the upper face of the needle, so that the needle is pressed against its seat under the effect of the pressure prevailing in the accumulator. When injection is to be initiated, the distributor is switched to make the said chamber delimited by the upper face of the needle communicate with low-pressure feed means so as to make the pressure exerted on the upper face of the needle drop so that the needle can lift.

To end the injection, the distributor is switched again into the other position, so as to re-establish the accumulator pressure over the upper face of the needle, so that the control means return the needle onto its seat without it being necessary for the injection pressure to be dropped. Injection therefore takes place entirely at the high pressure of the accumulator, thus avoiding drips at the end of injection.

Furthermore, the injection pressure is independent of the engine speed.

Such devices, which are advantageous from the points of view of combustion quality and control of unburnt hydrocarbons, do, however, present other drawbacks. Specifically, if the needle does not close properly or if the needle seat is damaged, the fuel present at high pressure in the accumulator will spill out into the combustion chamber, with a risk of the engine becoming overheated and destroyed.

Furthermore, as the permanent pressure of the common rail is sealed in by numerous plungers sliding in bores, a significant level of leakage creates mechanical losses, heating of the fuel and disturbs metering accuracy.

BRIEF SUMMARY OF THE INVENTION

The invention proposes to overcome these drawbacks and to provide an injection device that allows fuel to be injected at high pressure throughout practically the entire duration of injection, independently of engine speed.

Another object of the invention is to produce such a device which, in an extremely simple way, allows an accurate and determined dose of fuel to be delivered in a very short period of time and at a very high pressure.

Another object of the invention is to produce such a device in which injection can be performed at very high pressure throughout the injection phase.

Yet another object of the invention is to produce such a device in which injection can be performed very quickly using relatively slow means of establishing a high pressure.

Yet another object of the invention is to produce such a device with a reduced number of conventional components and, in particular, to use just one pumping and metering element to supply a number of injectors, thus guaranteeing a good balance between the deliveries injected into the various cylinders.

Another object of the invention is to produce such a device in which the rate of injection can be varied, in a simple way, during injection, particularly to provide a start of injection at a low rate then to continue injection at a higher rate, using the technique sometimes known as rate shaping.

Another object of the invention is to obtain the advantages of the common rail system with a low level of leakage.

Another object of the invention is to reduce the energy consumption of the injection device.

Another object of the invention is to obtain these advantages without using electronic means which are ill suited to certain environments.

The subject of the invention is a device for the discontinuous and cyclic injection of atomized liquid fuel at high pressure into a combustion chamber of an internal combustion engine with variable-volume working chamber, which includes, an injection nozzle comprising:

a nozzle cavity which communicates with a combustion chamber via at least one injection orifice, shut-off means allowing the communication between the said nozzle cavity and the said combustion chamber to be interrupted and re-established cyclically, and means of delivering liquid fuel under high pressure, these means being capable cyclically of delivering a metered amount of liquid fuel at high pressure, the said delivery means communicating, via cyclic-communication means, with a variable-volume injection chamber delimited by one wall of a moving element returned by elastic return means towards a fixed stop establishing the minimum value of the said variable volume of the said injection chamber, and which permanently communicates with the said nozzle cavity, the said injection chamber being intended temporarily to receive the said metered amount of liquid fuel, the said metered amount of liquid fuel being delivered cyclically by the said delivery means into the said injection chamber during the phase of cyclic closure of the said means of shutting off the injection nozzle, characterized in that the said elastic return means include a volume of fluid under pressure acting on the said moving element.

As a preference, the said moving element, the wall of which delimits the aforementioned injection chamber, is formed by a plunger sliding in a cylinder in order to delimit the said chamber. Because the pressures on each side of the plunger can be practically balanced, the risk of leakage at the plunger can be practically eliminated.

As a particular preference, the pressurized fluid contained in the volume and exerting its return effect may be fuel kept under pressure in an accumulator.

As a preference, the moving plunger or element may be designed to seal against any leaks between the injection chamber and the said volume of liquid fuel under pressure, when it is pressed against its stop.

The fluid under pressure may act on the said moving element via a multiplication means, particularly a differential plunger.

The injection nozzle may advantageously be a nozzle of the conventional type, containing three cavities, namely a first chamber or sac communicating by injection orifices with the combustion chamber, a second chamber communicating with the first chamber and having a seat, the said chamber being delimited by the lower part of a sliding needle, the end of which has a bearing surface capable of pressing against the said seat to interrupt this communication, and a third, cylindrical, chamber in which a part of the needle that forms a plunger slides, so as to form above the needle a third chamber which is associated with control means.

The shut-off means formed, for example, by such a needle may be controlled, for opening them, by electromagnetic means in a way known per se.

These shut-off means may be sensitive to the pressure of the liquid fuel in the nozzle cavity, for example the aforementioned second chamber, so that when a high pressure is established in this cavity, the needle lifts against its return means as far as an against-the-stop position. This solution is preferred in the present invention and may be obtained simply by a direct and permanent communication between the said nozzle cavity and the said injection chamber.

The said shut-off means may, for closing them, be sensitive to the action of a return spring.

They may also, for closing them, be sensitive to the action of a fluid under pressure, particularly liquid fuel.

However, as a preference, the said shut-off means may be sensitive, for closing them, to the direct action of the aforementioned moving element of the injection chamber, so that the moving element, when it returns to its against-the-stop position, moves the shut-off means towards a sealing position.

This solution is particularly advantageous, because it makes it possible to ensure that the injection of atomized liquid fuel into the combustion chamber takes place at a high pressure, including in the very last moments of injection.

The stop for the moving element may then consist of the said shut-off means, such as the needle, when they reach their closed position. It is, however, just as possible to envisage a fixed positive stop, for example formed by a shoulder or seat of the injection chamber, and against which the moving element comes to rest after having closed the aforementioned shut-off means, such as a needle, then having travelled a very short additional distance by virtue of an elastic contact between the moving element and the said shut-off means, for example by simple elastic compression of the shut-off needle when the latter is of an elongate shape.

The means of delivering liquid fuel at high pressure may be entirely conventional and in particular may comprise a simple conventional reciprocating injection pump, the plunger of which is in permanent contact with the cam of a camshaft. Advantageously, this pump may be a metering pump, for example comprising, as is known in the field of injection pumps, a helical discharge ramp and pump plunger angular-position adjustment.

It is possible to use centralized means of establishing pressure for several injection devices associated with each plunger and the pump may then be a conventional distributor pump.

In an advantageous embodiment, the said means of cyclic communication which are arranged between the said means of delivering liquid fuel at high pressure and the said variable-volume injection chamber comprise a one-way communication means.

Furthermore, they may, in particular, include a valve arranged upstream of the said one-way means and arranged in such a way as to place the said means of establishing high pressure in communication with a low-pressure discharge, therefore causing the said one-way means to close so that the said metered amount of fuel can be determined by the time taken for the said valve to close.

The said valve may simply be a two-way valve.

When the aforementioned nozzle shut-off means are sensitive, for closing them, to the pressure in a cavity containing liquid fuel, a valve, preferably the aforementioned valve arranged upstream of the said one-way means may be provided, for placing the said cavity in communication with a discharge in order to allow the said shut-off means to open.

In this case, the same valve controls the connection-to-discharge of the said means of establishing high pressure and of the said cavity containing the liquid fuel acting, for the closure operation, on the said shut-off means so that when the said valve is closed, the said delivery means deliver the liquid fuel under high pressure to the said injection chamber through the said one-way communication means, whereas opening the said valve brings about the end of the said delivery and, as the same time, allows the said shut-off means to open and fuel to be injected into the combustion chamber.

It is also possible to establish an offset between the instant of the end of metering and the instant of the start of injection, by leaving the plunger of the pump to deliver the fuel under pressure until it reaches it uppermost point, the pressure then being sustained by virtue of a flat cam profile. In this case, the valve closure instant determines how much volume will be injected, because the dose of fuel received by the injection chamber is determined by the working stroke of the pump between the instant of closure and the arrival at the uppermost point. Contrastingly, subsequent opening of the valve determines the start-of-injection moment.

In another embodiment, it is possible, for opening the shut-off means, to use the pressure drop that is due to the downstroke of the pump plunger after it has reached its uppermost point. The energy of the expansion of the volume of fuel compressed between the pump plunger and the shut-off means, such as the needle, may then advantageously be recovered on the means that drives the pump plunger.

In this case, the function of the two-way valve may be fulfilled by a pump conventional rotary distributor and an electrically controlled valve becomes unnecessary.

Remarkably, the invention lends itself to the injection of liquid fuel into a multi-cylinder engine comprising injection nozzles specific to each cylinder. The pump or means of delivering liquid fuel at high pressure is then connected separately to each nozzle by identical specific pipes, and means are arranged for sending the fuel to the various nozzles in turn. These means may simply consist of a single conventional distributor type pump and it is remarkable that this pump may advantageously be connected to a low-pressure discharge by a single two-way valve, simple control of which allows all of the operations of the injection cycle to be determined, unless the purely hydromechanical solution defined hereinabove is adopted.

Where this is the case, the aforementioned elastic means of returning the moving elements preferably consist of a single centralized means, for example a single accumulator containing liquid fuel placed at high pressure and acting on the said moving elements, the moving elements preferably being arranged in the respective nozzles in coaxial alignment with the means of shutting off the said nozzles.

The aforementioned one-way communication means are then advantageously individually arranged at each nozzle in such a way as to reduce the compressed and uninjected amount of fuel.

In order to vary the rate of delivery of fuel injected during the injection phase, for example by establishing a low injection rate at the start of injection and a high rate for the rest of injection, the device may advantageously comprise means allowing the fuel from the injection chamber to be sent to the nozzle cavity at a limited flow rate so that at the start of injection the rate of injection is equal to a determined rate from the injection chamber, reduced by a rate that corresponds to the increase in volume in the nozzle cavity brought about, by example, by the lifting of the injector shut-off means.

To this end it is possible, for example, to envisage arranging in the direct communication between the injection chamber and the injector cavity, a restriction or nozzle with a calibrated orifice allowing the flow rate sent to the injector cavity to be limited, the shut-off means such as the needle then being associated with means allowing the needle lift to be controlled during a determined period of time. This means may itself be a restriction slowing the rate of discharge of the fluid that controls the shut-off means.

This means may possibly be arranged like a variable cross section restrictor so that the needle lift follows a determined time-based profile.

BRIEF DESCRIPTION OF THE DRAWINGS

Other features and advantages of the invention will become clear from reading the following description, given by way of non-limiting example, and referring to the appended drawings, in which.

DETAILED DESCRIPTION OF THE INVENTION

Figure 1:
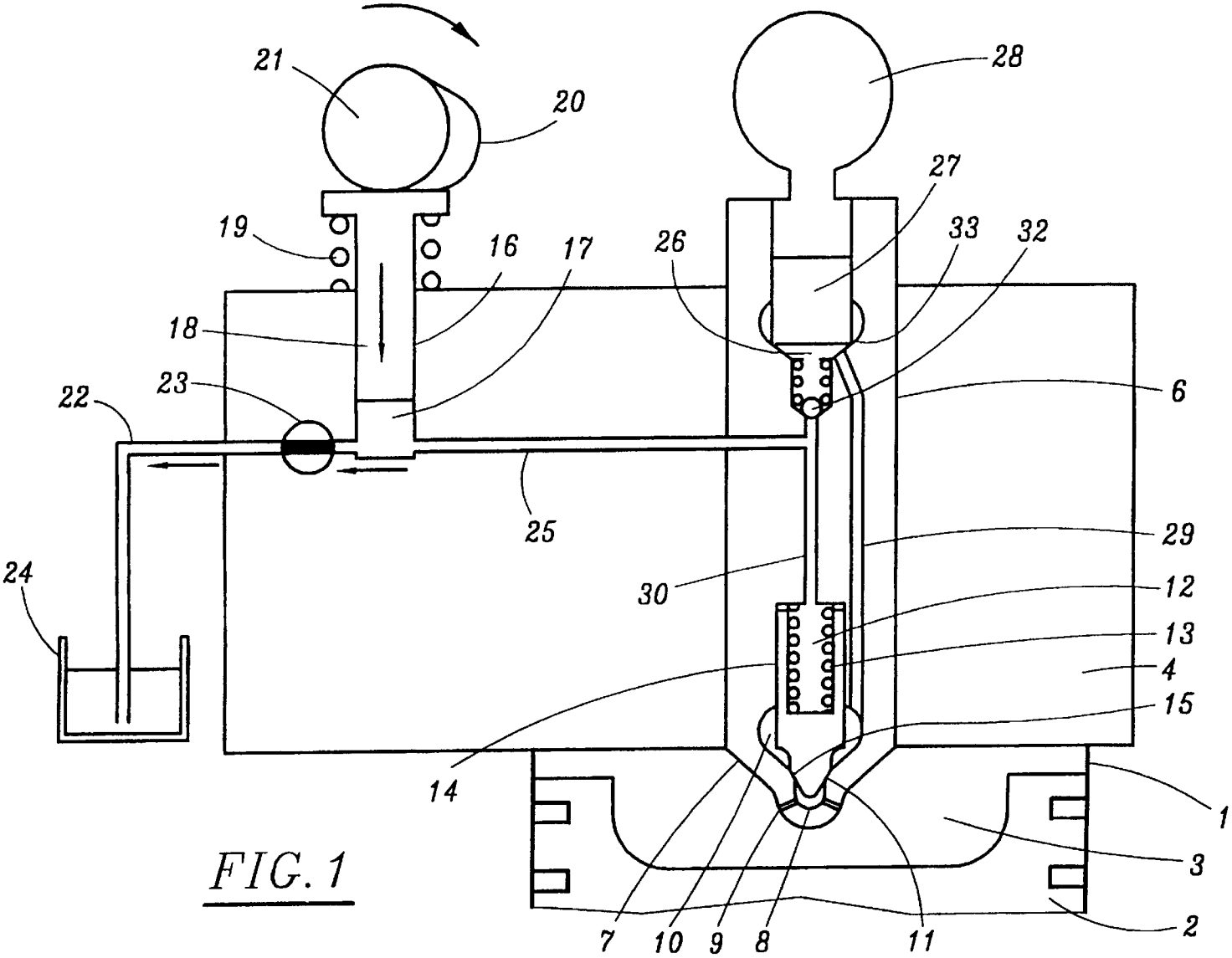
FIGS. 1 to 4 depict an injection device according to a first embodiment of the invention during four successive situations namely, in succession, a phase of sweeping and refilling the pump, a metering phase, the start-of-injection position and the end-of-injection position.

Reference is first of all made to FIGS. 1 to 4.

The injection device described is associated with a cylinder 1 of a diesel engine, in which there slides a piston 2 and delimiting, above it, a combustion and working chamber 3 closed off by a cylinder head 4. Placed, preferably centrally and coaxial with the chamber in which the engine piston 2 slides there is an injector 6 which may be produced in an entirely conventional way. This injector includes a nozzle 7, the lower end of which opens into the working chamber 3 and which includes an internal cavity forming a succession of three chambers, namely a first chamber or sac 8 of small volume, in permanent communication with the working chamber 3 via injection holes 9, a second chamber 10 located above a conical seat 11 and a third, cylindrical, chamber 12 at the end, which forms a stop, of which there rests a spring 13 which pushes towards the bearing surface 11 a conventional shut-off needle 14 sliding in the cylindrical chamber 12 and the narrowed front end of which has a bearing surface 15 which presses in leaktight fashion against the seat 11.

The device further includes a pump 16 of a conventional type allowing a high fuel pressure to be established. This pump consists of a pump cylinder 17 in which there may slide a delivery plunger 18 returned to its lowermost point by a spring 19 against the cam 20 of a camshaft 21 kinematically tied to the crankshaft (not depicted) of the engine. The compression chamber 17 communicates via a pipe 22 in which there is a simple two-position valve 23, with the low-pressure fuel-supply source 24. Furthermore, the compression chamber 17 communicates directly with the aforementioned third chamber 12 via a pipe 25 which opens into a pipe 30.

The device according to the invention also includes an injection chamber or cavity 26 in which a moving element 27, consisting of a plunger, slides against a powerful return means 28 which may be a spring but which is preferably a volume of pressurized fluid, for example an accumulator filled with liquid fuel under pressure, preferably designed to act upon the plunger 27 with a force that is substantially constant throughout the working stroke of the plunger. The injection chamber 26 constantly communicates with the aforementioned second chamber 10 via a pipe 29. Finally, the communication between the chamber 26 and the compression chamber 17 is provided by the pipe in which a one-way valve 32 is fitted.

In the position of rest, the plunger or moving element 27 rests against a front stop 33 of the chamber 26, so that the volume of the chamber 26 is minimal.

Advantageously, the stop 33 provides a sealing seat so that when the plunger 27 is in this position, no leaks from the accumulator 28 towards the chamber 10 are possible.

Operation is as follows.

In the sweeping position depicted in FIG. 1, the injection needle 14 is pressed against its seat 11 by the return spring 13. The moving element or plunger 27 is pressed against its stop 33 by the powerful spring 28. The pump plunger 18 begins its downstroke under the action of the cam 20. The two-position valve 23 is in the open position which means that the pump chamber 17 and the third cavity 12 are at the low fuel pressure.

In the second chamber 10 the pressure level is low enough for the needle to be pressed against its seat by the spring 13. The displacement of the pump plunger 18 has little effect on the pressures.

Figure 2:
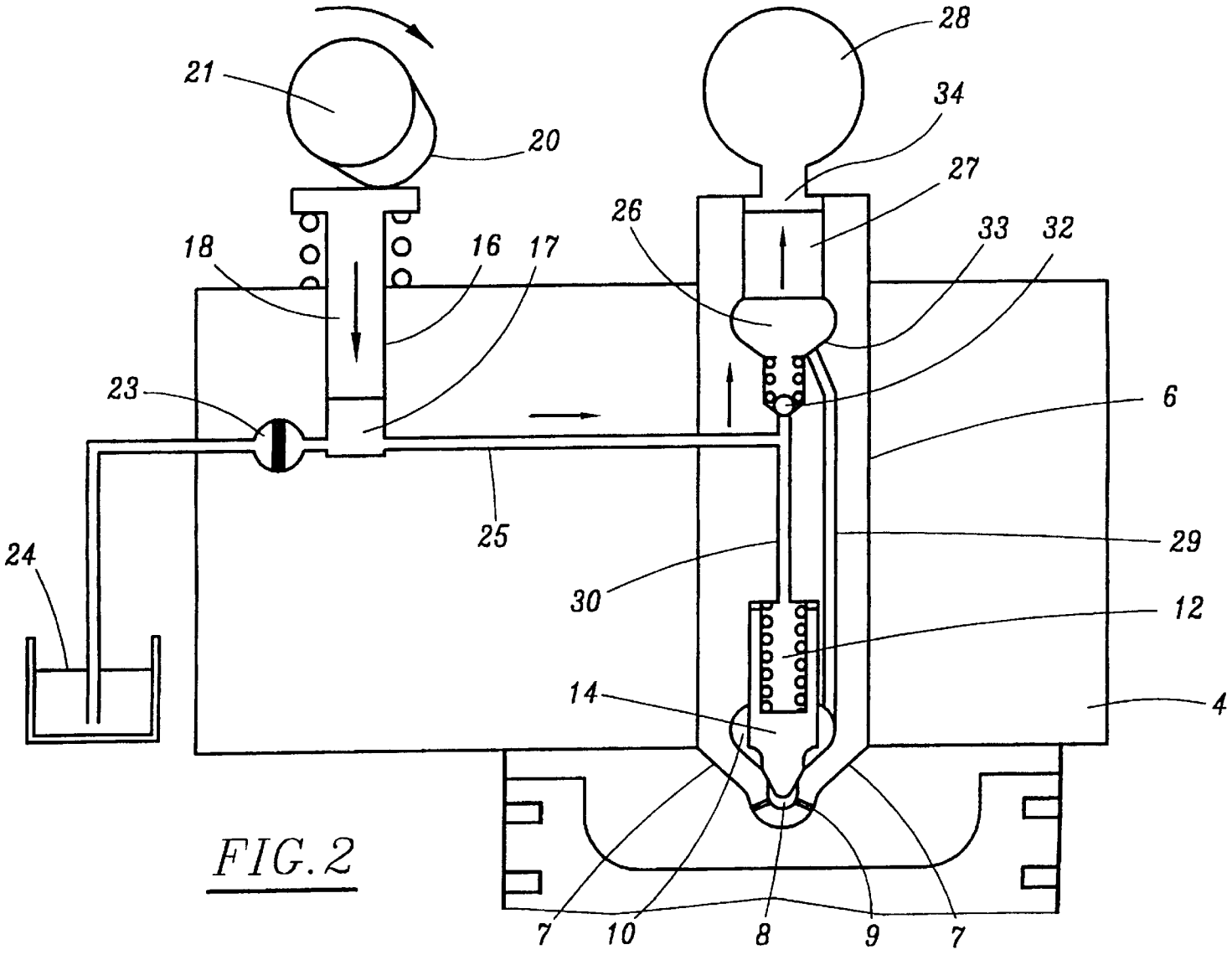

The rest of the process is depicted in FIG. 2: at a given moment t in the engine cycle, the two-way valve 23 is rapidly closed. The injection plunger 18, continuing its stroke, immediately raises the fuel pressure in the chamber 17 and therefore in the chamber 12. At the same time, the liquid is driven towards the injection chamber 26 and the plunger 27 is pushed back against the action of its powerful spring while the same pressure establishes itself in the second chamber 10. The high pressure of the liquid fuel in the chamber 17, the chamber 26, the second chamber 10 and the third chamber 12 is determined by the force of the spring 28 whose return force is preferably almost constant. Thus, the liquid fuel is subjected to the high pressure which will be the injection pressure, for example 1600 bar.

For as long as the two-position valve 23 is closed and the injection pump plunger 18 continues its delivery stroke, the injection plunger 27 retreats, compressing its elastic means 28 at constant force and storing up in the chamber 26 fuel that has come from the chamber 17.

Figure 3:
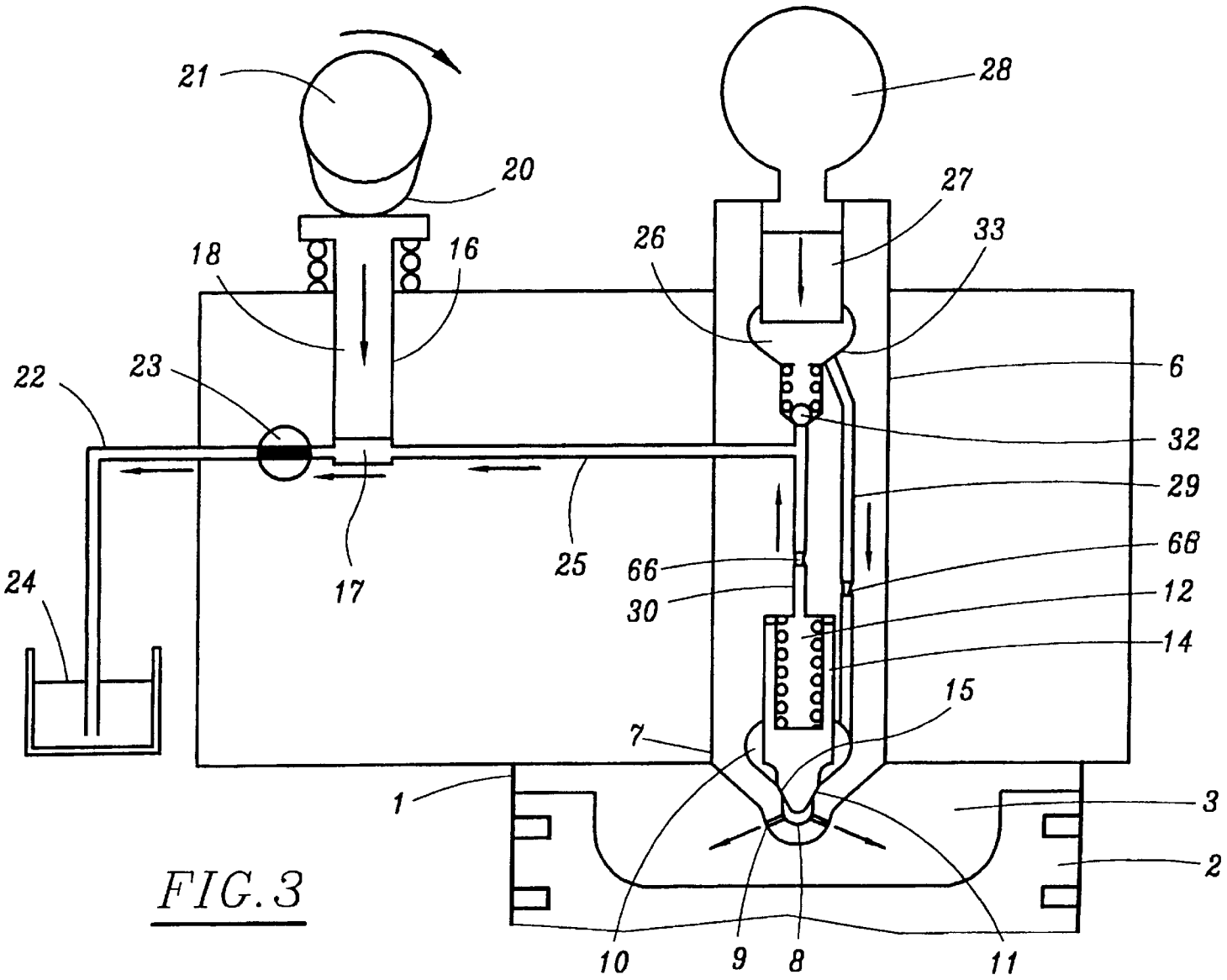

At the moment $t+\Delta t$, that is to say at the instant when the desired dose of fuel has been introduced, at the high injection pressure, into the chamber 26 and when injection proper is to commence, the two-position valve 23 is quickly re-opened as depicted in FIG. 3.

The chamber 17 and the third chamber 12 immediately find themselves at the low pressure, notwithstanding a possible continued downstroke of the pump plunger 18. The one-way valve 32 immediately closes and the chamber 26 becomes isolated from the pumping chamber 17.

As the third chamber 12 is at a low pressure, the high pressure prevailing in the chamber 10 will lift the injection needle 14 which will in turn compress its return spring 13, until it comes to rest on its upper stop, establishing a communication, via the first chamber 8 and the injection orifices 9, with the working chamber of the engine. In consequence, the liquid fuel at the high injection pressure is injected and atomized into the working chamber.

This high-pressure injection continues throughout the duration of the displacement of the plunger 26 under the action of its return means 28 until the plunger comes against its stop 33, which means that a volume of fuel that corresponds to all and only all of the dose previously delivered into the chamber 26, is ejected through the orifices 9.

Figure 4:
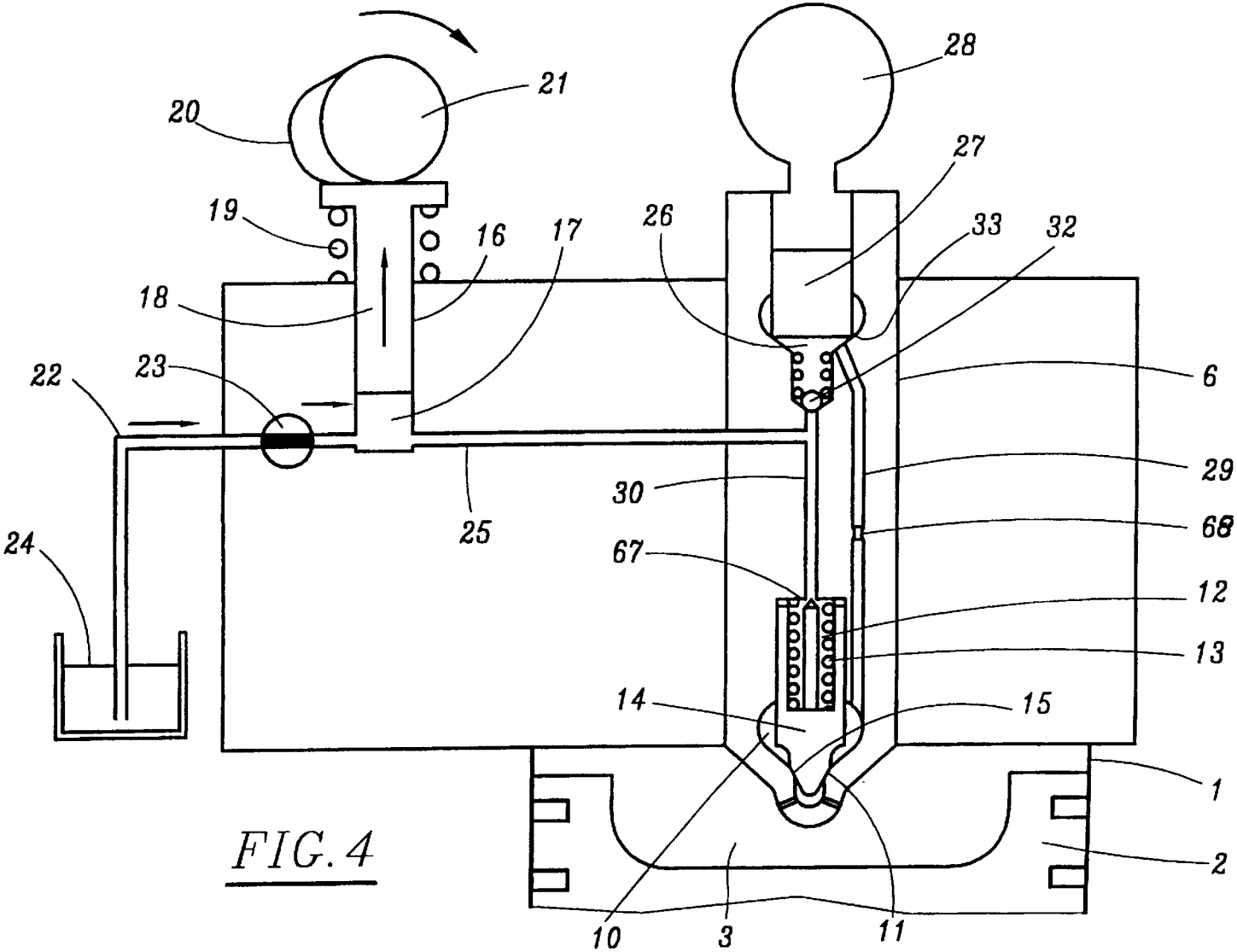

At the end of injection, depicted in FIG. 4, the moving element 27 comes into abutment against the seat 33 and the pressure in the second chamber 10 drops sharply until it becomes insufficient by comparison with the elastic return force of the spring 13 on the needle 14, which is then sharply returned onto its seat.

The metering and the start of injection can be adjusted independently of one another simply by controlling a simple two-position valve 23.

The end-of-metering moment and the start of injection can also be offset, for example by using a cam which has a flat high profile part for stopping fuel from being sent to the metering chamber 26 while at the same time maintaining the pressure in the third chamber 12, it being possible for the moment of injection to be chosen at will on the flat part of the cam by opening the valve 23. In this case, the fuel is discharged from the pump 16 starting from the moment that the valve 23 closes and throughout the remaining displacement of the pump plunger 18 towards its uppermost point.

Finally, it is also possible, without opening the valve 23, to wait for a drop in pressure in the chamber 12 brought about by the plunger 18 returning to its lower-most point.

The injection phases are also completely independent of the position of the cam 20.

The pump 16 can therefore be crude and of low delivery rate because it has most of the engine cycle available in which to deliver fuel to the injection chamber.

In the examples just described, the pump 16 is not directly designed to deliver an adjustable dose of fuel, this dose being quantified by the stroke of the plunger 18 travelled in the time At taken for the valve to close.

It will, however, be appreciated that use may also be made of engine fuel injection pumps of the conventional type equipped with a reversed-helix ramp and a device for rotation about the axis of the pump plunger so that a discharge orifice formed in the cylindrical wall of the pump can be closed and opened. The pump plunger then acts as the two-position valve 23.

Reference is now made to FIGS. 5 to 8, in which the components which have the same functions as in the earlier description have the same reference numerals.

This embodiment is intended for multi-stage injection, for example with pre-injection, for limiting leaks and mechanical losses, and reduces the influence of the compressibility of the liquid fuel on the operation of the device to a minimum.

In this embodiment, the pipe 30 is omitted and the pipe 25 from the pump 16 opens, via a one-way valve 32, directly into a chamber 34 which simultaneously constitutes the second chamber of the injector 12 and the injection chamber replacing the chamber 26. The needle has an extension 48, the diameter of which exceeds that of the seat of the needle 14 and which can slide through a hollow moving plunger 50 forming the moving element of the injection chamber 34 and which may itself slide in a cylinder forming a chamber 35 into which a high-pressure-liquid-fuel accumulator 28 opens. The extension 48 has, in the chamber 35, a collar 49 the diameter of which is markedly smaller than that of the chamber 35 and against which the thrust of a needle-return spring 13 can act. The upper end of the extension 48, beyond the collar, slides in a cylinder which determines the third chamber 12 of the needle, to form a plunger, the diameter of which is somewhere between the diameter of the seat of the needle and the diameter of the extension 48.

The volume of the chamber 35, and therefore the accumulator 28, communicate with the third chamber 12 via a pipe 51 which starts off radially and then becomes axial made in the extension 48 and which opens, via an end restriction, into the chamber 12. Incidentally, this chamber is connected to the low-pressure fuel source 24 by a valve 52 situated close to the chamber 12 and a pipe 53.

Figure 5:
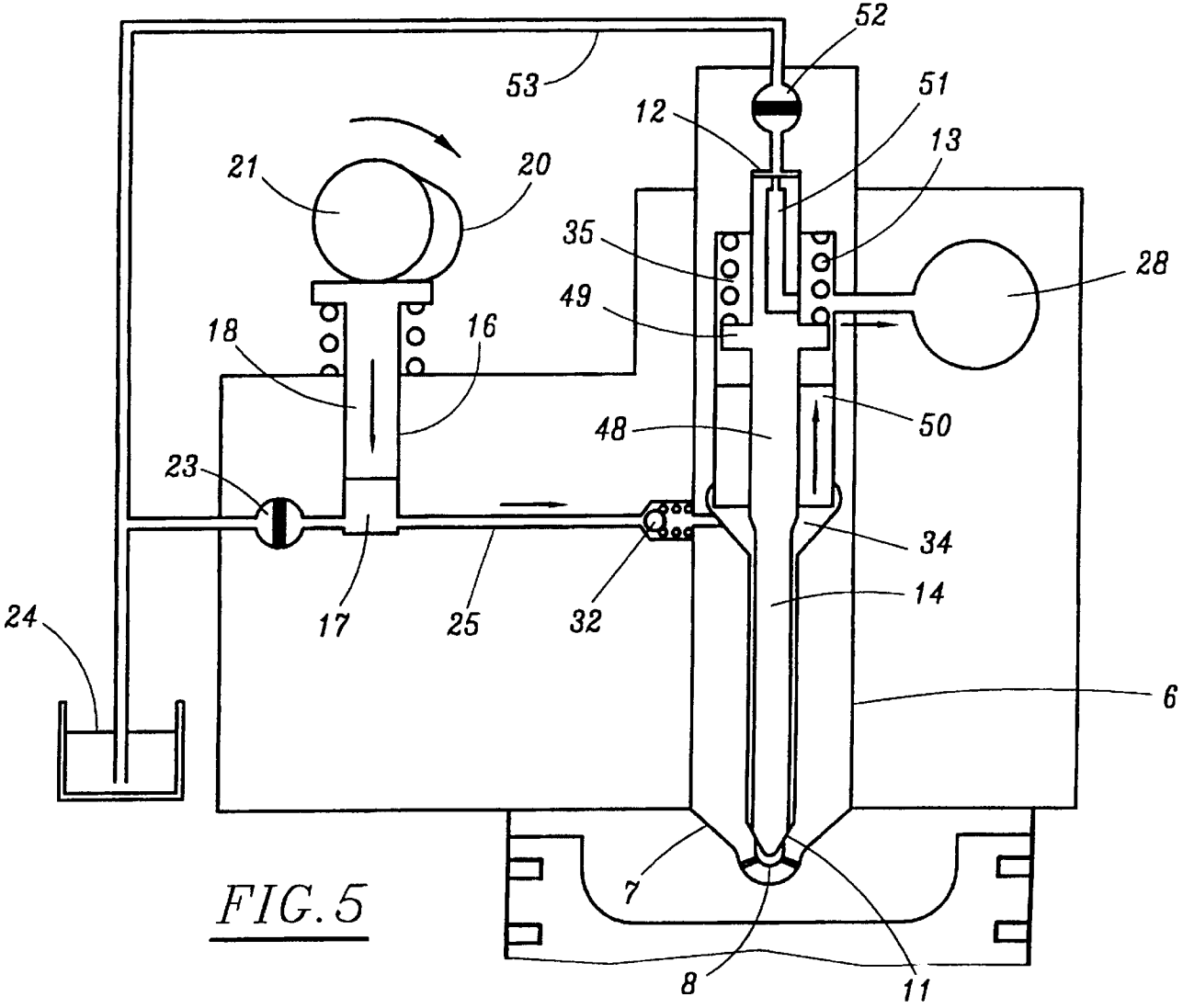
FIGS. 5 to 8 depict four phases in the operation of another form of the invention.
Figure 6:
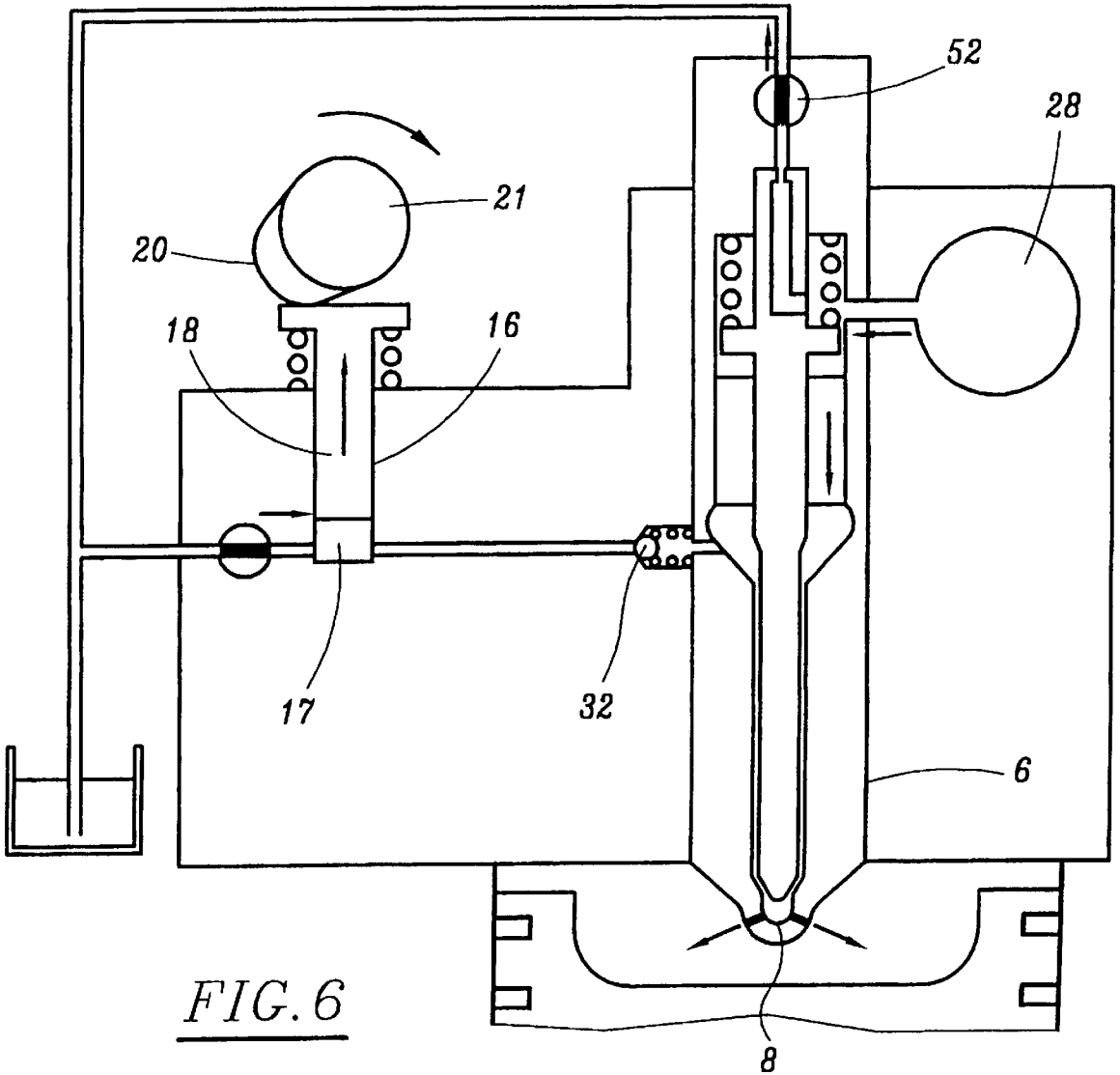

In the filling position depicted in FIG. 5, the first and second valves 23, 52 are closed and the pump 16 delivers fuel at high pressure through the pipe 25 into the chamber 34 so that the plunger 50 moves in the direction of the arrow and delivers the fuel that lies in the chamber 35 to the accumulator 28. All of the forces exerted by the fuel and by the spring 13 on the needle 14 keep this needle pressed against its seat 11. After the pump reaches its uppermost point, the valve 32 closes and the cam recovers the energy of compression of the volume of fuel contained in the chamber 17 and the pipe 25. The pressure in the various cavities of the injector 6 is then determined by the pressure in the accumulator 28. Opening the first valve 23 causes the pressure in the pump to drop. The valve 52 can then be opened as can be seen in FIG. 6. This results in an immediate drop in pressure in the third chamber 12 which means that the needle 14 is pushed into the open position. The chamber 34 is then in communication with the first chamber 8 and the fuel from the chamber 34 is ejected and atomized under the pressure of the plunger 50 that is subjected to the pressure prevailing in the accumulator 28. The restriction in the pipe 51 prevents the accumulator from emptying.

Figure 7:
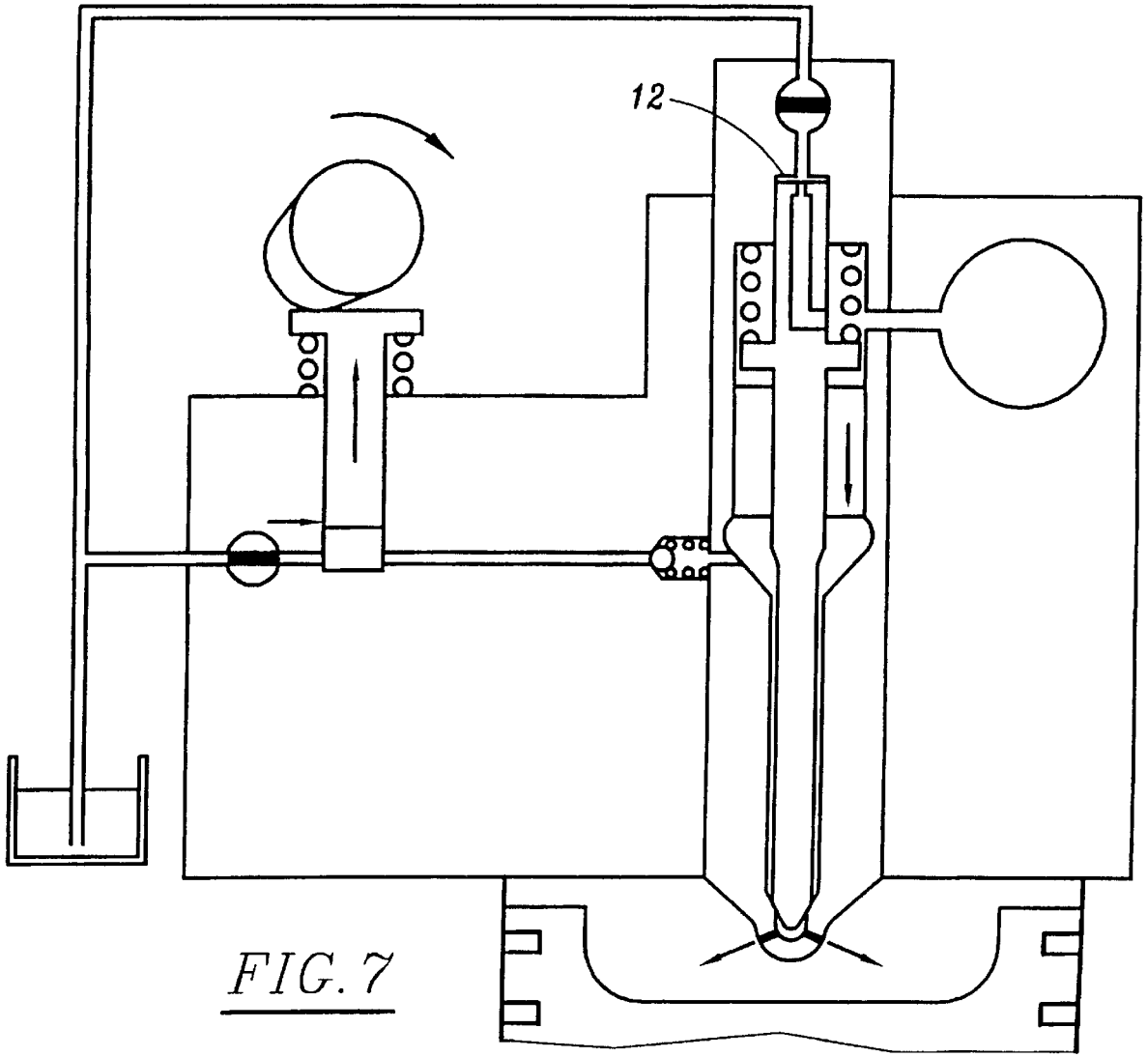
Figure 8:
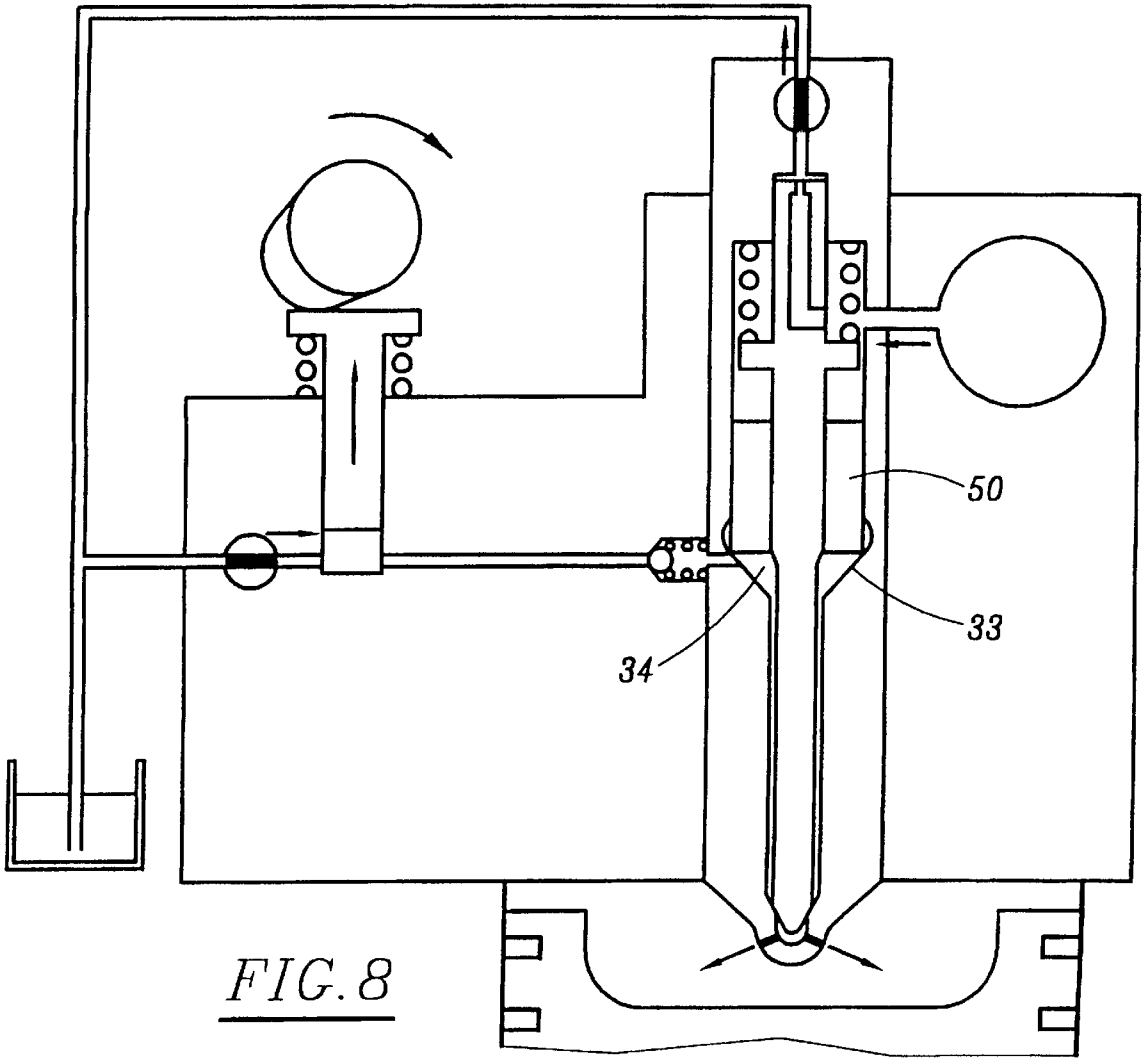

The valve 52 can then be closed quickly again as shown in FIG. 7 so that this first injection phase, which constitutes a pre-injection, finishes, the needle 14 being pushed back towards its seat on account of the increase in pressure in the chamber 12 and the action of the spring 13. It is thus possible, by opening and closing the valve 52 several times in succession, to bring about multi-stage injection. The end of injection is obtained, as shown in FIG. 8, when the entire injectable dose contained in the chamber 34 has been ejected and when the plunger 50 has come into sealed contact with its seat 33, so that the pressure in the chamber 34, reduced to its minimum volume, drops and the needle closes again quickly under the effect of the spring 13 and the pressure exerted on the differential area between the extension 48 and the chamber 12. The valve 52 is then closed again.

It will be understood that needle control is extremely quick and precise, especially since the valve 52 can be placed in close proximity to the third chamber 12. Furthermore, no transfer between an injection chamber and the second chamber of the injector is required, and this means that the dose injected is insensitive to the compressibility of the fuel. Finally, leaks are limited to the sweeping of the chamber 12 through its restriction during the short duration of the injection.

Reference is now made to FIGS. 9 to 12 which depict embodiments in which the needle is closed positively by the moving element of the injection chamber.

Figure 9:
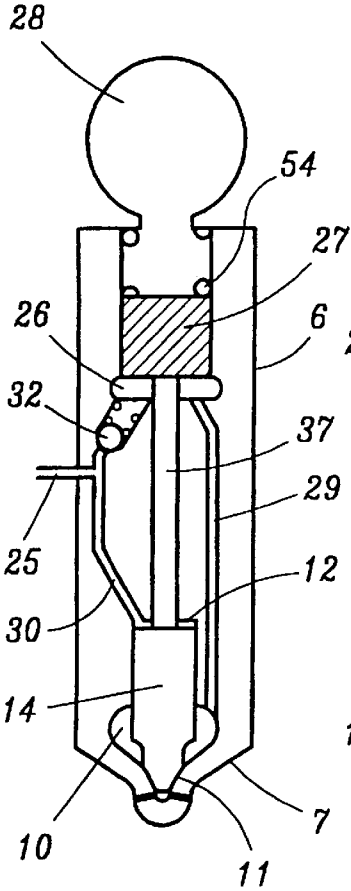

FIG. 9 shows an injector 6 similar to the one in FIG. 1 and the third chamber 12 of which has no return spring. The needle 14 is continued upwards in the form of a long extension 37 sliding in the body of the injector and emerging in an injection chamber 26 that is connected to the pipe 25 via the valve 32 and the pipe 30. The plunger 27, which delimits the injection chamber 26, is acted upon by its return means, namely the accumulator 28 and by a spring 54, used only when stationary.

When the pump 16 delivers fuel to the injection chamber 26, the chamber 12 is under pressure and the needle 14 is pressed against its seat 11. During this time, the plunger 27 rises and the volume of the chamber 35 increases, the plunger 27 moving away from the end of the shank 37 of the needle.

Operation is similar to the operation of the device of FIG. 1. When the valve 23 opens, the pressure in the third chamber 12 drops and the needle immediately lifts until it comes against the end of the chamber 12. The plunger 27 starts to move down from its raised position and the fuel is ejected via the pipe 29 and the chamber 10. Towards the end of the downstroke of the plunger 27 urged by the pressure prevailing in the accumulator 28, the plunger 27 comes against the end of the shank 37 and returns the needle downwards into the closed position. Once the needle 14 is pressed against its seat 11, the shank 37 forms a stop for the plunger 27. The spring 54 is simply intended to make sure that the needle 14 is closed and the plunger kept in the position that corresponds to a minimum volume of the chamber 26 when, for example, with the engine stopped, the pressure in the accumulator 28 has not yet built up.

Figure 10:
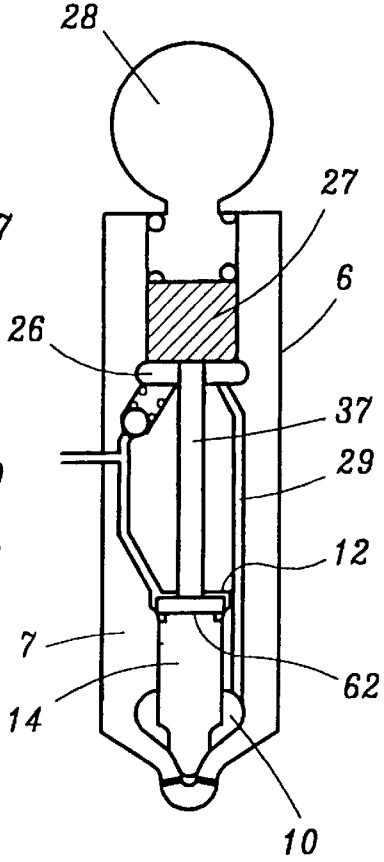

Reference is now made to FIG. 10 which shows a device similar to the device of FIG. 9, but in which the needle 14 has a second sealing surface 62 which interacts with a seat made in the chamber 12 and avoids leaks likely to come from the accumulator 28 through the clearance between the needle 14 and the nozzle body 7.

Figure 11:
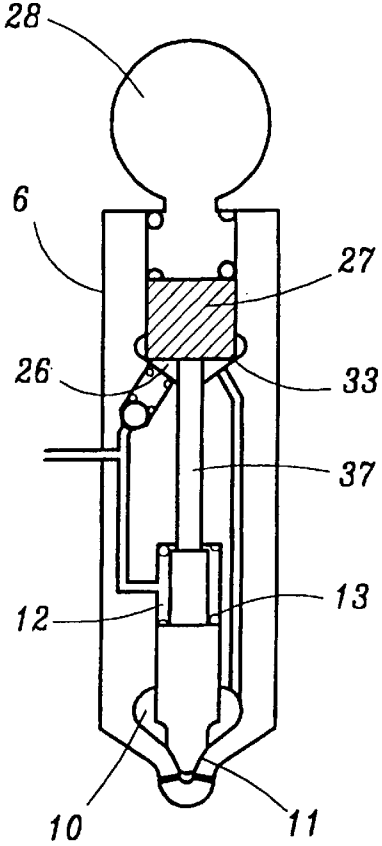

The device of FIG. 11 is similar to the one in FIG. 9 except that the plunger 27 rests against a seat 33 in the injection chamber 26 after having compressed the needle 14. In this case, a spring 13 with a short travel is depicted in the chamber 12 for pressing the needle 14 onto its seat 11 even when, with the accumulator 28 not under pressure, the plunger 27 is not acted upon. In this embodiment, the length and diameter of the shank 37 are chosen such that the needle 14 is pressed against its seat 11 by the plunger 27 shortly before this plunger has reached its position against the stop 33, the rest of the downstroke of the needle being allowed by the deformation of the shank 37 under compressive stress.

Figure 12:
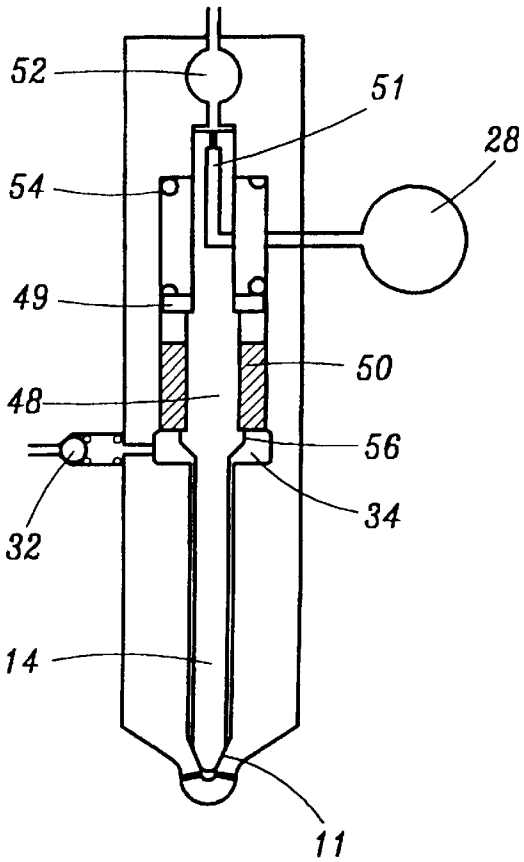
FIGS. 9 to 12 depict other embodiments of the injector of the invention.

The embodiment of FIG. 12 is similar to that of FIG. 5, the difference being that the needle 14 is closed, as in FIG. 9, by the impact of the injection plunger 50 against the stop 56 offered by the needle.

Figure 13:
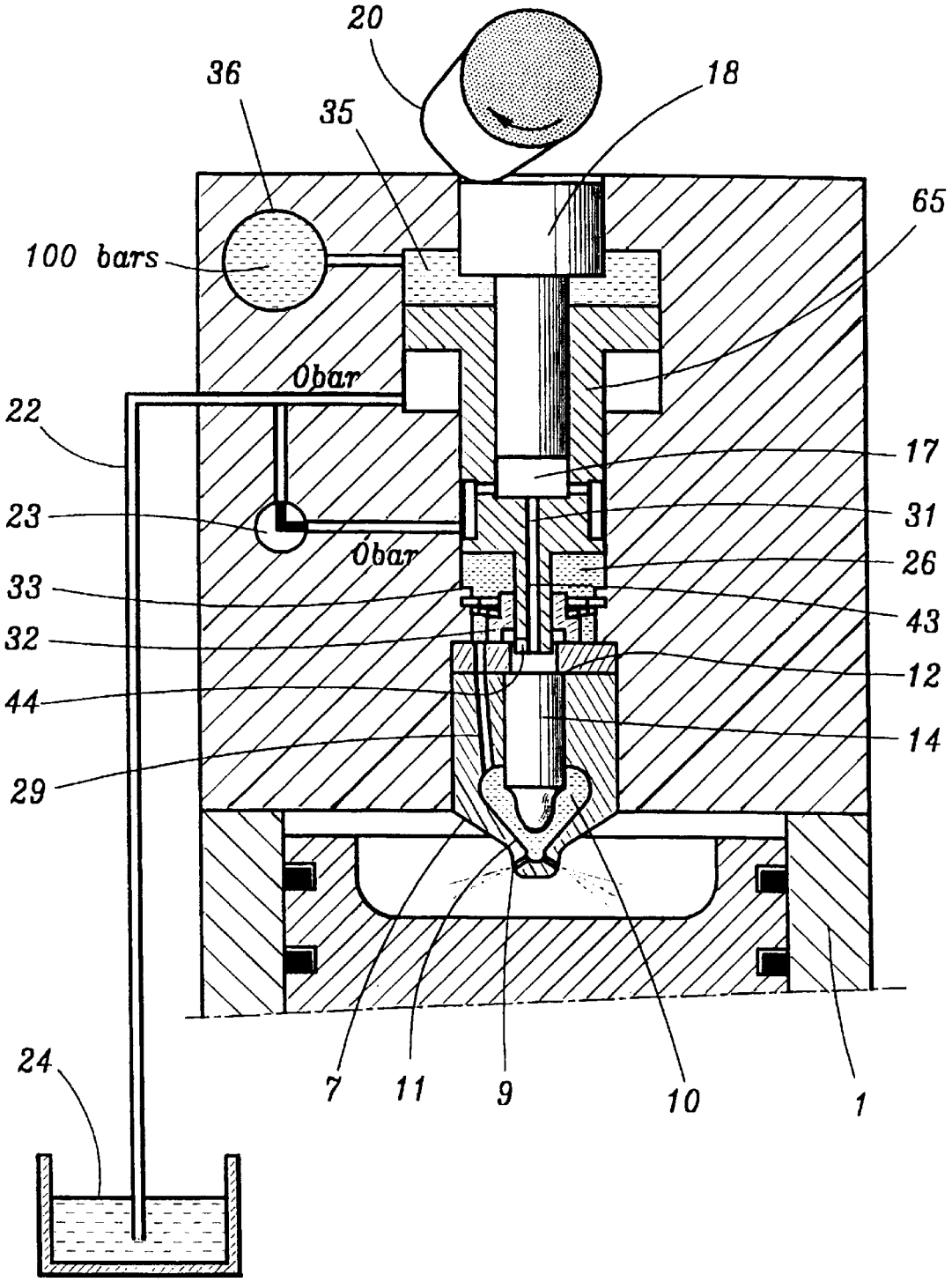
FIG. 13 depicts another embodiment of the invention in which the elements of the device are arranged coaxially.

Reference is now made to FIG. 13.

In this embodiment, which is very well suited to high fuel-injection quantities, the nozzle, the injection chamber and its moving element, and the pump that generates the high pressure are coaxially aligned along the axis of the nozzle 7.

The plunger 18 of the pump slides in a cylindrical chamber 17 defined inside the moving element 65 with a differential plunger returned in the injection direction by the elastic return means which consists of the pressurized fluid 35, for example air, in communication with an accumulator 36. The communication between the inlet of low-pressure fluid through the two-way valve 23 and the pump chamber 17 is via a radial passage made in the moving element 34 and communicating with the valve 23 via a longitudinal port formed in the surface of the moving element 65.

The injection chamber 26 is arranged under the moving plunger 65, and its end-of-travel stop 33 can be seen. The pipe 31 allowing the pump 16 and the chamber 26 to communicate, is an axial pipe which runs in an extension 43 which extends, in the direction of the nozzle, beyond the active plunger surface of the part 65 which delimits the chamber 26 and which, at its free end, has a radial slot 44. A one-way valve 32 sliding in a sealed fashion on the said extension 43 and normally pressed against the face of the nozzle 7 by a spring such as, for example, a Belleville washer. When this valve lifts, the duct 31 places the pump 16 into communication with the chamber 26. Finally, it can be seen that the needle 14, which is depicted in the figure in its position of maximum lift, has its upper end opposite a volume 12 situated under the end of the extension 43 containing the duct 31, which volume is also delimited by the valve 32 when this valve is in its closed position.

During the sweeping phase, the cam 20 is in a position which allows the pump plunger 18 to rise and draw in fuel from the low-pressure source 24 through the valve 23 which is in the communication position so that the pump chamber 17 fills.

After a certain time, with the cam 20 having rotated, the plunger 18 will begin its downstroke. At a moment t during this downstroke, the two-way valve 23 is closed. The fuel present in the pump will then be pressurized so that the valve 32 lifts against its return means and so that fuel pressurized in the pump is transferred into the chamber 26, so that the moving part 65 rises and the volume of the chamber 26 increases, while the high pressure is established in the chamber 10, just as in the volume 12 that lies above the needle 14, through which the fuel flows to reach the chamber 26. The needle 14 therefore remains firmly pressed against its seat.

At the moment $t+\Delta t$ the valve 23 is opened. In consequence, the pressure drops immediately in the pump 16 and in the volume into which the duct 31 opens and which communicates with the third chamber 12. At this instant, the needle 14 lifts because of the pressure in the second chamber 10, until it comes up against its stop as in the injection position depicted in FIG. 6 in which the volume of the chamber 12 has become minimum. The elastic return means 35, 36 push the moving element 65 back downwards, discharging the fuel from the injection chamber 26 towards the second chamber 10 whence it is expelled via the injection orifices 9 and atomized.

Towards the end of its downstroke, the plunger 65 comes into contact, via the lower end of its end piece 43, with the needle 14 which is in its lifted position depicted in the figure. As the moving part 65 continues its downstroke, it therefore drives the needle 14 downwards until this needle is pressed against its seat, this allowing the needle to close sharply while the pressure in the chamber 10 is still at its high value, which means that an excellent quality end-of-injection is obtained. Once the needle 14 has come up against its stop, the moving part 65 descends slightly further downwards, by virtue of the elastic compression of its extension 43 containing the duct 31 and then stops definitively as it comes into contact with the stop 33.

It will be understood that in this embodiment, which is highly advantageous when compressed air is available, no springs are needed for returning the needle 14, because the needle is pressed against its seat by the elastic tension in the extension 43 of the part 65 which is itself pressed firmly against its seat 33 by the pressure of the means 35, 36.

Incidentally, the device depicted is particularly compact and the paths followed by the fuel leaving the pump 16 are particularly short, which minimizes the influence that the compressibility of the fuel has on the accuracy of the dose injected and also makes it possible, in the case of an engine that has several cylinders, to envisage injection devices that are practically identical and therefore deliver practically identical doses to each cylinder, including speed and load conditions where only very small doses are injected.

Figure 14:
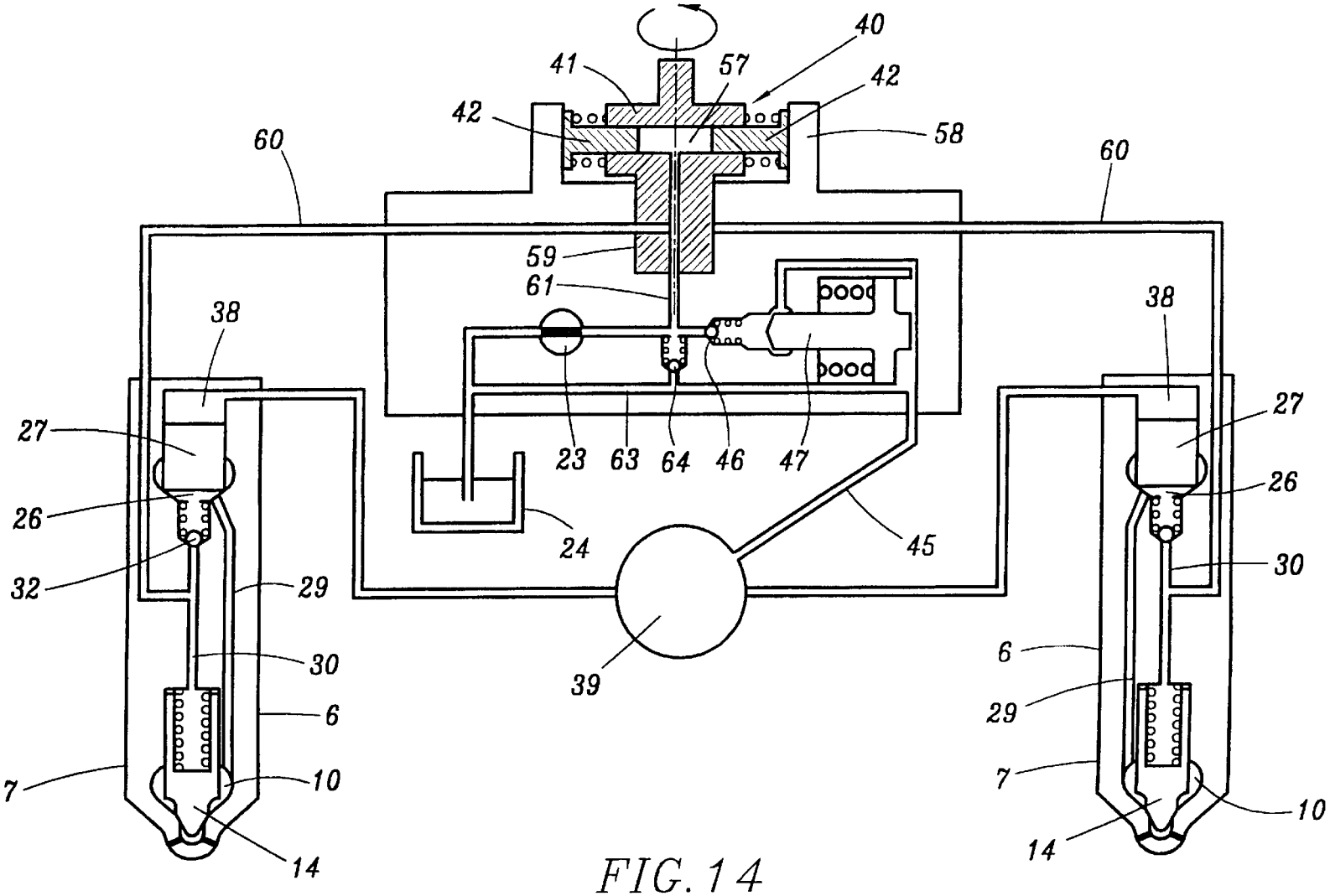
FIG. 14 depicts a view of a centralized injection device for a multi-cylinder engine.

Reference is now made to FIG. 14.

This figure depicts two of the four injectors 6 of a device according to the invention intended for a four-cylinder engine. These injectors 6 are, for example, identical to the injector in FIG. 1. The plunger 27 of each injector delimits, via its other wall, a return chamber 38. All the return chambers 38 are connected directly to a single accumulator for liquid fuel at high pressure 39.

Incidentally, the device includes a common distributor pump 40 operated by a driven shaft.

The pump 40 is of a type that is conventional in injection devices for multi-cylinder engines and therefore need not be described. It includes a rotor 41 with four radial plungers 42 sliding in the pump cylinders 57 in which they move as the rotor rotates, under the effect of a stationary cam 58, the known profile of which is determined by the number of cylinders and therefore of injectors 6. The lower part of the rotor forms a distributor 59 capable of sending liquid fuel under pressure to the various injectors 6 in turn via pipes 60 which replace the pipes 25 in FIG. 1 and lead to the pipe 30 of the various injectors. Incidentally, the pump chamber 57 permanently communicates with a central pipe 61 connected to a low-pressure source of fuel 24 via a two-position valve 23 and, in parallel, a pipe 63 with a one-way valve 64.

This pump 40 can also be used to sustain the high pressure in the accumulator 39, by employing an assembly that communicates with the pipe 61 and comprises a one-way means 46 and a pressure-regulating valve 47 that is conventional in such accumulators and is connected to the accumulator by a pipe 45.

It will be noted that these centralized means of sustaining the pressure in the accumulator 39 will draw a minimum equivalent and balanced amount of fuel from the injection to each cylinder.

In operation, the pump 40 rotates with the engine. Controlling the valve 23 allows a metered amount of fuel to be sent in turn to each of the injectors 6, which fuel travels along the pipe 60 and through the one-way valve 32 to the injection chamber 26 of the injector. Each injector operates in the same way as in the device depicted in FIGS. 1 to 4.

It will therefore be understood that it is possible, using one simple two-way valve, to control the injection to each of the cylinders in an extremely precise way, and to do so using just one distributor-type metering pump 40 and just one elastic return means 39. Furthermore, injection takes place with characteristics which are constant from one cylinder to the next because the injection chambers 26 are in close proximity to the second cavities 10 and the pipes 60 can easily be designed to have identical internal volumes.

Of course, the metering means and needle-control means described hereinabove can just as easily be applied to this case of a centralized device for several cylinders.

In particular, it is possible to envisage replacing the valve 23 with the rotary distributor and using the pump plunger returns to open the injectors. The injection advance will then be set by the angular position of the cams 58 in the pump 40, in a way known per se.

Reference is made to FIG. 3. To provide a timebased rate profile during injection with an initial injection part at low rate followed by injection at high rate, a nozzle or restriction member 68 which limits the flow rate passing through this communication to the maximum value of flow rate desired for injection has been installed in the pipe 29.

A second nozzle 66 is placed in the pipe 30 for controlling the lever of the shut-off needle 14.

At the start of injection, the rapid increase in fuel pressure from the injection chamber is communicated to the nozzle cavity 10 and lifts the needle 14. This lifting is not, however, instantaneous, because the nozzle 66 slows down the discharge of fuel from the chamber 12 situated above the needle, which means that the needle takes a certain amount of time to reach the fully open against-the-stop position. Because of the nozzle 68, the delivery finally injected throughout the needle lifting period, which causes an increase in volume in the cavity 10, is equal to the regulated delivery passing through the communication 29 decreased by the delivery needed to increase the volume of the cavity 10. Once the needle has reached the against-the-stop position, this last delivery is cancelled and the entire nominal delivery passing through the communication 29 is discharged through the injection nozzle 9.

The nozzle that slows down the needle lift can also be produced in the form of a variable cross section nozzle 67, the cross section being altered as the needle 14 lifts, this making it possible to obtain any desired rate shape at the start of injection.

Of course, the nozzles 68 and/or 66, 67 may be functionally replaced by a suitable sizing (diameter and length and therefore pressure drop) of the lines 29 and 30.

What is claimed is:

1. Device for the discontinuous and cyclic injection of atomized liquid fuel at high pressure into a combustion chamber (3) of an internal combustion engine with variable-volume working chamber, which includes, an injection nozzle (7) comprising, for each working chamber:

a nozzle cavity (10, 34) which communicates with the combustion chamber via at least one injection orifice (9), shut-off means (14) allowing the communication between the said nozzle cavity (10, 34) and the said combustion chamber (3) to be interrupted and re-established cyclically, and means (16, 40) of delivering liquid fuel under high pressure, these means being capable cyclically of delivering a metered amount of liquid fuel under high pressure, the said delivery means (16, 40) communicating, via cyclic-communication means, with a variable-volume injection chamber (26, 34) delimited by one wall of a moving element (27, 50, 65) returned, each cycle, by elastic return means (28, 36, 39) as far as a fixed stop (33, 37, 56) establishing the minimum value of the said variable volume of the said injection chamber, and which permanently communicates with the said nozzle cavity (10, 34), the said injection chamber being intended temporarily to receive the said metered amount of liquid fuel, there being an injection chamber (26, 34) for each working chamber, the said metered amount of liquid fuel being delivered cyclically by the said delivery means (16, 40) into the said injection chamber during the phase of cyclic closure of the said means (14) of shutting off the injection nozzle, characterized in that the said elastic return means comprise a volume of fluid under pressure, acting on the said moving element.

2. Device according to claim 1, characterized in that the said elastic return means (28, 36, 39) comprise an accumulator of fluid under pressure.

3. Device according to claim 1, characterized in that the said moving wall is formed by a plunger (27, 50, 65) sliding in a cylinder.

4. Device according to claim 1, characterized in that the said nozzle cavity and the said injection chamber constitute a single chamber (34).

5. Device according to claims 2 to 4, characterized in that the said plunger (50) is a hollow plunger capable of sliding around part (48) of the said shut-off means (14).

6. Device according to claim 1, characterized in that the said elastic means (28, 36, 39) of returning the said moving element (27, 50, 65) push the moving element back with a force which is substantially constant throughout the ejection of the dose of fuel contained in the said injection chamber (26, 34).

7. Device according to claim 1, characterized in that, in order to vary the flow rate of fuel injected, it comprises restriction means (65) so that the volume displaced by the shut-off means (14) as it opens reduces the rate of delivery into the chamber at the start of injection, normal delivery rate being reached when the shut-off means (14) reach the fixed stop position.

8. Device according to claim 7, characterized in that it comprises constant- or variable-restriction means (66, 67) on a passage (30) connected to a chamber (12) for controlling the shut-off means (14), so as to control the rate at which the said shut-off means lift.

9. Device according to claim 7, characterized in that the said moving element (27, 65) interacts with a stop (33) which acts as a sealing seat limiting leaks between the said injection chamber and the said pressurized return fluid.

10. Device according to one of claims 2 to 9, characterized in that the said fluid under high pressure contained in an accumulator (28, 36, 39) at substantially constant pressure is liquid fuel.

11. Device according to claim 1, characterized in that the means (14) of shutting off the nozzle are sensitive to a difference in pressure between the said nozzle cavity (10, 34) and a control cavity (12).

12. Device according to claim 1, characterized in that the said shut-off means (14) are controlled by electromagnetic means.

13. Device according to claim 1, characterized in that the said shut-off means (14) are sensitive, for closing them, to a return spring (13).

14. Device according to claim 1, characterized in that the said shut-off means (14) are sensitive, for closing them, to the action of a fluid under pressure, especially liquid fuel.

15. Device according to claim 1, characterized in that the said shut-off means (14) are sensitive, for closing them, to the action of the said moving element (27, 50) in such a way that when the moving element (43) regains its against-the-stop position, it displaces the shut-off means (14) towards a sealing position.

16. Device according to claim 15, characterized in that the said fixed stop (37, 56) for the moving element (27, 50) consists of the said shut-off means (14) in their closed position.

17. Device according to claim 15, characterized in that the moving element (27, 50) compresses the said shut-off means (14) onto their seat (11) before it reaches its stop (33).

18. Device according to claim 1, characterized in that the said means for delivering liquid fuel under high pressure include a plunger-type pump (16, 40) actuated by a shaft driven by the engine.

19. Device according to claim 18, characterized in that the said pump is a metering pump, especially of the type having a helical discharge ramp and plunger angular-position adjustment.

20. Device according to claim 1, characterized in that the said means of cyclic communication which are arranged between the said means (16, 40) for delivering liquid fuel under high pressure and the said variable-volume injection chamber (26, 34) include a one-way communication means (32).

21. Device according to claim 20, characterized in that the said cyclic communication means include a valve (23) arranged upstream of the said one-way means (32) and arranged in such a way as to place the said means of establishing high pressure in communication with a low-pressure discharge (24) therefore causing the said one-way means to close so that the said metered amount of fuel is determined by the stroke travelled by the pump plunger during the time taken for the said valve (23) to close.

22. Device according to claim 21, characterized in that the said valve (23) is a two-way valve.

23. Device according to claim 14, taken in isolation or in combination with one of claims 17 to 21, characterized in that a cavity (12) containing liquid fuel, to which fuel the said shut-off means (14) are sensitive for closing them, can be placed in communication with a discharge (24) by means of a valve (23, 52) so as to allow the said shut-off means to open.

24. Device according to claim 21, characterized in that the same valve (23) controls the connection-to-discharge (24) of the said means (16) of establishing high pressure and of the said cavity (12) containing the liquid fuel acting, for the closed position, on the said shut-off means (14), so that when the said valve is closed, the said delivery means deliver the liquid fuel under high pressure to the said injection chamber (26) through the said one-way communication means (32), whereas opening the said valve brings about the end of the said delivery and, at the same time, allows the said shut-off means to open until they reach their stop and allows the fuel to be injected into the combustion chamber.

25. Device according to claim 23, characterized in that the said cavity (12) containing the liquid fuel acting, for the closed position, on the said shut-off means (14) is in communication with a volume (28, 35) containing fuel under pressure acting as a means for elastically returning the said moving element (50).

26. Device according to claim 25, characterized in that the said chamber (12) containing liquid fuel, to which fuel the said shut-off means (14) are sensitive for controlling them, can be connected to a discharge (24) via a second valve (52), and in that the communication of the said chamber (12) with the said volume (35, 28) of liquid fuel under pressure is by means of a restriction.

27. Device according to claim 24, characterized in that the profile of the cam acting on the plunger has a flat part allowing the pressure in the said cavity (12), to which pressure the said shut-off means are sensitive, to be sustained so that the instant at which the said valve opens, and therefore the moment of injection, can be chosen to lie on the flat part of the cam while at the same time being offset from the end of filling of the said injection chamber.

28. Device according to claim 10, in which the means of establishing high pressure comprise a plunger-type pump, characterized in that the shut-off means are sensitive, for opening them, to the pressure drop brought about by the downstroke of the plunger of the pump for establishing high pressure.

29. Device according to claim 1, characterized in that the said injector and the said injection chamber (26, 34) are aligned coaxially.

30. Device according to claim 29, characterized in that the said means (16) of establishing high pressure is aligned coaxially with the injector.

31. Device according to claim 1, characterized in that it includes, for an engine having a number of working chambers, a number of injection nozzles (6) and unique and centralized means (40) for delivering and metering liquid fuel under high pressure, these means being connected separately to each nozzle by a substantially identical specific pipe (60), the said means of establishing high pressure being arranged to send liquid fuel under high pressure to the said nozzles in succession.

32. Device according to claim 31, characterized in that the said elastic means of returning the said moving elements (27) comprise a common accumulator (39) containing liquid fuel placed under high pressure and acting on the said moving elements (27).

33. Device according to claim 32, characterized in that the said unique and centralized means (40) of delivering liquid fuel under high pressure are connected to the said accumulator (39) so as to sustain the high pressure in the above-mentioned accumulator by means of a pressure regulator and a one-way means.

34. Device according to one of claims 32 and 33, characterized in that the said means (40) of establishing high pressure consist of a unique pump (40) associated with distributor means (59) and in that the said pump is connected to a low-pressure feed means by a valve (23) which ensures that all of the injectors of the device operate in succession.

* * * * *